US007140447B2

(12) United States Patent
Krawiec et al.

(10) Patent No.: US 7,140,447 B2
(45) Date of Patent: Nov. 28, 2006

(54) SUBSURFACE ANNULAR SAFETY BARRIER

(75) Inventors: Peter Krawiec, Bonnyville (CA); Dwayne D. Leismer, Basiglio (IT); Youel G. Hilsman, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 210 days.

(21) Appl. No.: 10/702,883

(22) Filed: Nov. 6, 2003

(65) Prior Publication Data

US 2004/0129433 A1 Jul. 8, 2004

Related U.S. Application Data

(60) Provisional application No. 60/424,417, filed on Nov. 7, 2002.

(51) Int. Cl.
*E21B 33/12* (2006.01)

(52) U.S. Cl. ..... 166/387; 166/187

(58) Field of Classification Search ..... 166/387, 166/118, 126, 131, 133, 187
See application file for complete search history.

(56) References Cited

U.S. PATENT DOCUMENTS

| | | | | |
|---|---|---|---|---|
| 886,114 | A | 4/1908 | Collingwood | |
| 2,638,987 | A | 5/1953 | Condra | |
| 2,788,856 | A | 4/1957 | Ortloff | |
| 3,156,300 | A | 11/1964 | Page et al. | |
| 3,283,823 | A | 11/1966 | Warrington | |
| 3,876,000 | A * | 4/1975 | Nutter | 166/106 |
| 3,921,720 | A * | 11/1975 | Wetzel | 166/387 |
| 4,519,456 | A * | 5/1985 | Cochran | 166/312 |
| 4,609,042 | A * | 9/1986 | Broadus et al. | 166/187 |
| 4,660,647 | A | 4/1987 | Richart | |
| 5,027,895 | A | 7/1991 | Barton | |
| 5,211,243 | A | 5/1993 | Strattan et al. | |
| 5,341,874 | A * | 8/1994 | Wilson | 166/196 |
| 5,456,322 | A * | 10/1995 | Tucker et al. | 166/386 |
| 5,495,892 | A * | 3/1996 | Carisella | 166/387 |
| 5,507,343 | A | 4/1996 | Carlton et al. | |
| 5,697,448 | A * | 12/1997 | Johnson | 166/369 |
| 6,046,685 | A | 4/2000 | Tubel | |
| 6,234,247 | B1 | 5/2001 | Head | |
| 6,257,338 | B1 * | 7/2001 | Kilgore | 166/387 |
| 6,302,214 | B1 * | 10/2001 | Carmichael et al. | 166/373 |
| 6,966,386 | B1 * | 11/2005 | Ringgenberg et al. | 166/387 |

FOREIGN PATENT DOCUMENTS

| | | |
|---|---|---|
| WO | WO 94/18429 | 8/1994 |

* cited by examiner

*Primary Examiner*—William Neuder
*Assistant Examiner*—Nicole A Coy
(74) *Attorney, Agent, or Firm*—Henry L. Ehrlich; Kevin P. McEnaney; Jaime A. Castano

(57) ABSTRACT

A subsurface annular safety barrier including a tubing disposed within a wellbore casing forming a casing-tubing annulus to allow fluid flow from and/or to a subterranean formation, and an annular barrier carried by the tubing and positioned in the casing-tubing annulus proximate the top of a formation, separating communication between the formation and the upper portion of the casing-tubing annulus above the annular barrier, wherein the annular barrier is set in an open position to allow fluid communication between the formation and the upper portion of the casing-tubing annulus and operationally activatable, without mechanical manipulation of a pipe string, to a closed position to prevent undesired fluid flow between the formation and upper portion of the casing-tubing annulus.

5 Claims, 3 Drawing Sheets

SUBSURFACE ANNULAR SAFETY BARRIER

RELATED APPLICATIONS

This application claims the benefit of priority under 35 U.S.C. §119 of U.S. Provisional Application Ser. No. 60/424,417, filed Nov. 7, 2002, and entitled SUBSURFACE ANNULAR BARRIER, which is incorporated by reference herein.

FIELD OF THE INVENTION

The present invention relates in general subterranean wellbores and more specifically to selectively closing an annulus in the wellbore, below the surface, upon failure of the casing.

BACKGROUND

Wells in general, and wellbores specifically, are drilled down to a formation for the purpose of producing fluid from and/or injecting a fluid into a specific subterranean formation. To complete the well for production and/or injection of fluids the wellbore is typically lined with casing that is cemented within the wellbore drilled into the earth. The casing is opened to the desired formation to allow fluid communication between the earthen formation and the wellbore. The wellbore is often further completed with another string of pipe, referred to herein as tubing, disposed within the casing to a desired formation to provide a conduit between the formation and the surface.

As is well known in the art, fluid may be produced from a formation and/or injected into a formation through the tubing string and/or the tubing-casing annulus. Often fluid is injected into the formation at a point in time and then fluid is produced from the formation through the wellbore to the surface.

In some wells casing integrity may be jeopardized due to geologic conditions such as subsidence and fault movements, or from production methods such as steam injection. Loss of casing integrity, in wells without a downhole packer, can cause uncontrolled flow, which is hazardous to personnel and the environment.

In some well designs a downhole packer is positioned within the tubing-casing annulus separating the lower portion of the annulus from the upper portion of the annulus. While this well configuration provides fluid control through the annulus, it also prevents annular injection or annular production.

There are prior art devices to provide tubing isolation, but these devices do not provide a deep annular barrier upon casing failure. Some of these devices, such as annular safety valves and subsurface surface-controlled safety valves, control the flow in the tubing string or near the surface annulus. There are also surface flow control devices such as blow-out preventers. There are devices requiring mechanically rotation of the tubing at the surface to seal the casing-tubing annulus. These devices are undesirable due to the necessity to rig up for rotation.

Therefore, it is a desire to provide a subsurface annular safety barrier to provide control of the casing-tubing annulus proximate the top of the formation in the event of loss of casing integrity. It is a further desire to provide a subsurface annular safety barrier that permits annular injection and/or annular production when the casing integrity is intact.

SUMMARY OF THE INVENTION

In view of the foregoing and other considerations, the present invention relates to controlling fluid flow through the casing-tubing annulus proximate a formation top upon loss of casing integrity.

Accordingly, a subsurface annular safety barrier is provided that allows for production from and/or injection into a formation through the casing-tubing annulus and allows closing of the casing-tubing annulus by non-mechanical movements upon loss of integrity of the casing. The subsurface annular safety barrier system comprises a tubing disposed within the wellbore casing forming a casing-tubing annulus to allow fluid flow from and/or to a subterranean formation, an annular barrier carried by the tubing and positioned in the casing-tubing annulus proximate the top of a formation, separating communication between the formation and the upper portion of the casing-tubing annulus above the annular barrier, wherein the annular barrier is set in an open position to allow fluid communication between the formation and the upper portion of the casing-tubing annulus and operationally activatable, without mechanical manipulation of a pipe string, to a closed position to prevent undesired fluid flow between the formation and upper portion of the casing-tubing annulus.

A method of allowing production from and/or injection to a formation through the casing-tubing annulus and providing for closure of the casing-tubing annulus comprising the steps of completing a wellbore to a formation with casing, providing fluid communication between the formation and the wellbore, setting tubing within the casing to form a casing-tubing annulus, setting an annular barrier carried by the tubing proximate the top of the formation in an open position allowing fluid flow from the formation side of the annular barrier to an upper portion of the casing-tubing annulus, and allowing for the annular barrier to be activated from the open to the closed position blocking flow between the formation and the upper portion of the casing-tubing annulus.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
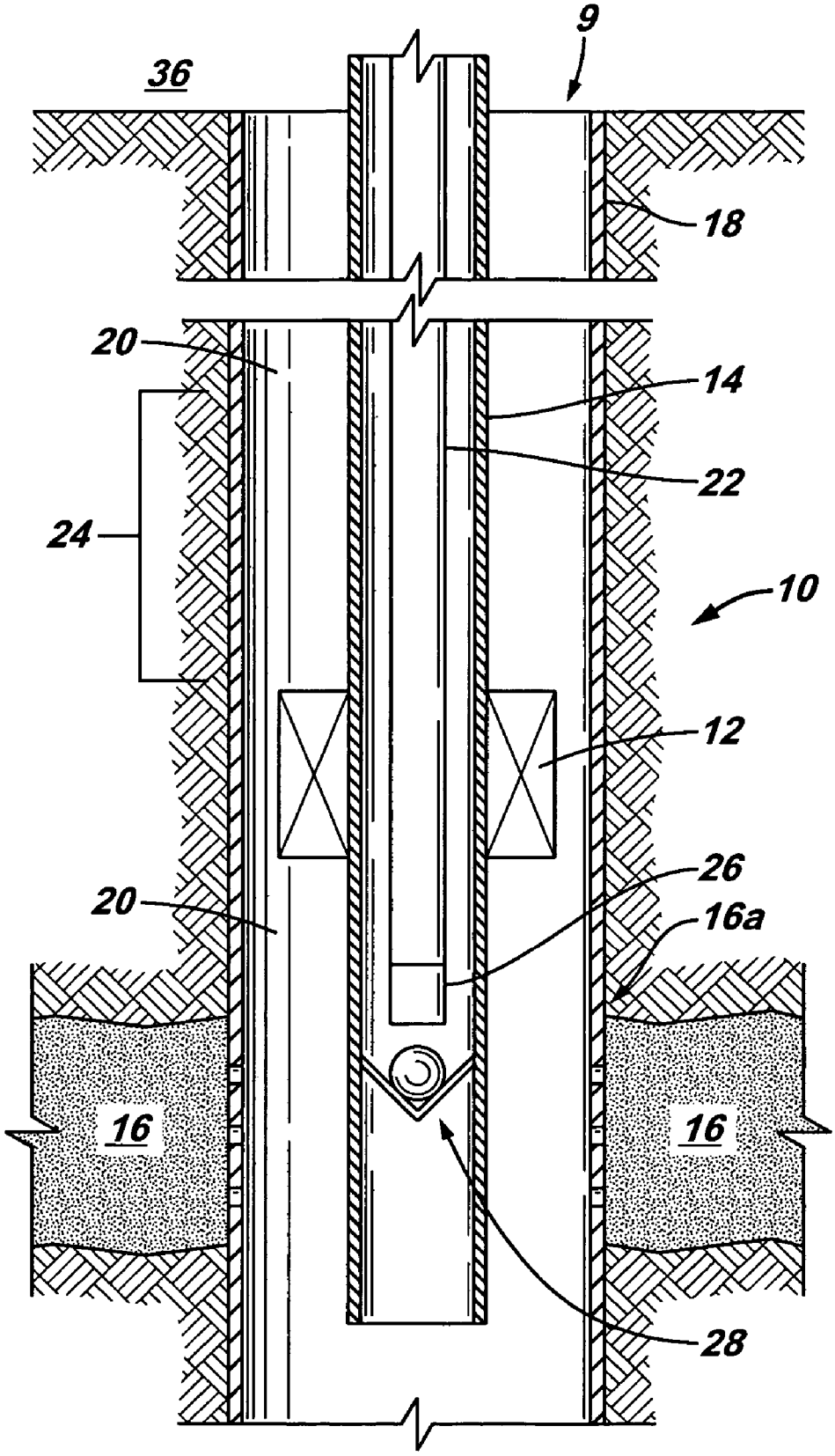
FIG. 1 is a schematic view of a subsurface annular safety barrier of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic view of a subsurface annular safety barrier of the present invention generally designated by the numeral 10. As shown, a wellbore 9 is drilled to a formation 16 and completed by running and setting casing 18. As is well known in the art, fluid communication is established between the formation 16 and wellbore 9 through casing 18.

Subsurface annular safety barrier 10 is run into casing 18 allowing production of fluid from, or injection of fluid into, formation 16 when casing 18 is intact through casing-tubing annulus 20. Subsurface annular safety barrier 10, as shown in FIG. 1, includes tubing 14 carrying annular barrier 12. As shown in FIG. 1, annular barrier 12 is a hydraulic activated packer. Annular barrier 12 is positioned within casing-tubing annulus 20 so as to separate formation 16 from an upper portion 24 of casing-tubing annulus 24. It is often desired to place annular barrier 12 above the section of casing 18 that is most susceptible to failure. It is often found that casing 18 failures occur at formation 16. Therefore, for exemplary purposes, FIG. 1 indicates annular barrier 12 positioned proximate the top 16*a* of formation 16.

The well shown in FIG. 1 is configured for production via beam type pumping methods. As such, a rod string 22 having a pump 26 and a pump check valve 28 is shown. As is well known in the art, rods 22 reciprocate and operate pump 26 to draw fluid produced from formation 16 through tubing 14 to the surface. Formation 16 fluid can be produced through tubing 14 while maintaining an open casing-tubing annulus 20 for additional production or fluid injection.

Operation of subsurface annular safety barrier 10 of the present invention is described with reference to FIG. 1. In this embodiment, tubing string 14 is run into wellbore 9 so that annular barrier 12, in the form of a hydraulic operated packer, is positioned proximate formation top 16*a*. Annular barrier 12 is positioned in the unset or open position to substantially unobstruct fluid flow through casing-tubing annulus 20 from the formation to the surface. Therefore, if desired, production of fluid from formation 16 may pass through casing-tubing annulus 20. Additionally, injection of fluid from the surface into formation 16 may be accomplished through casing-tubing annulus 20. One example of fluid injection is the injection of steam such as in a huff-and-puff operations.

If casing 18 fails, then annular barrier 12 may be activated to close casing-tubing annulus 20, separating the upper portion 24 of the annulus 20 from formation 16. By controlling the fluid flow in annulus 20 proximate formation 16 the well (formation 16) may then be killed through tubing 14 permitting more effective and less expensive repair of the well.

As shown in FIG. 1, hydraulic packer 12 is activated to close annulus 20 by pressuring up in tubing 14 against pump check valve 28. Other methods of activating annular barrier 12 may be utilized as shown in the following descriptions.

Figure 2:
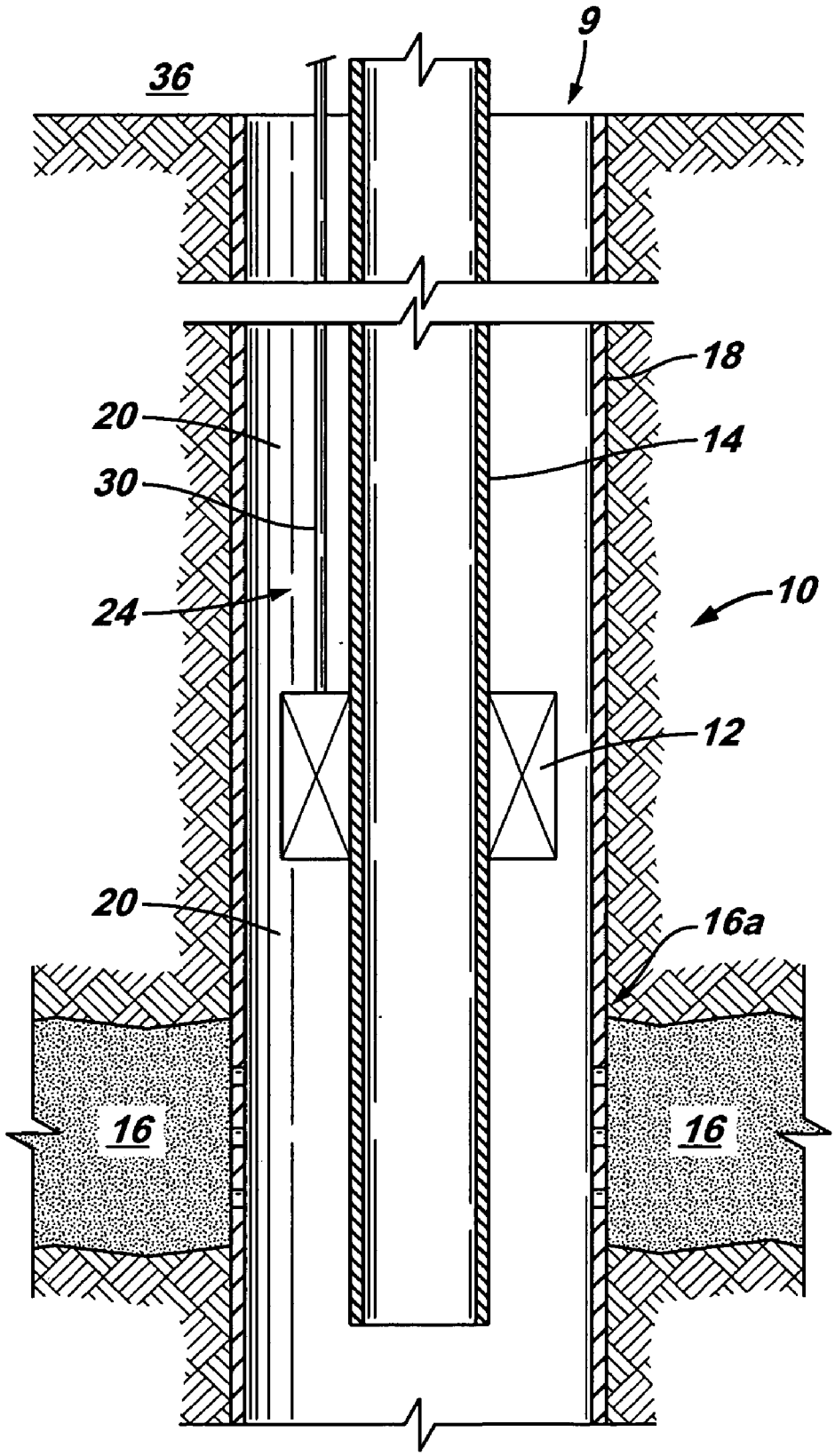
FIG. 2 is a schematic view of a subsurface annular safety barrier of the present invention.

FIG. 2 is another schematic illustration of the subsurface annular safety barrier 10 of the present invention. As shown in this illustration, annular barrier 12 is a hydraulic packer connected to the surface 36 by a control line 30. Control line 30 provides a conduit for applying hydraulic pressure from the surface 36 directly to annular barrier 12 to close casing-tubing annulus 20. Control line 30 may be manually operated or programmed to automatically set annular barrier 12 upon certain criteria.

Figure 3:
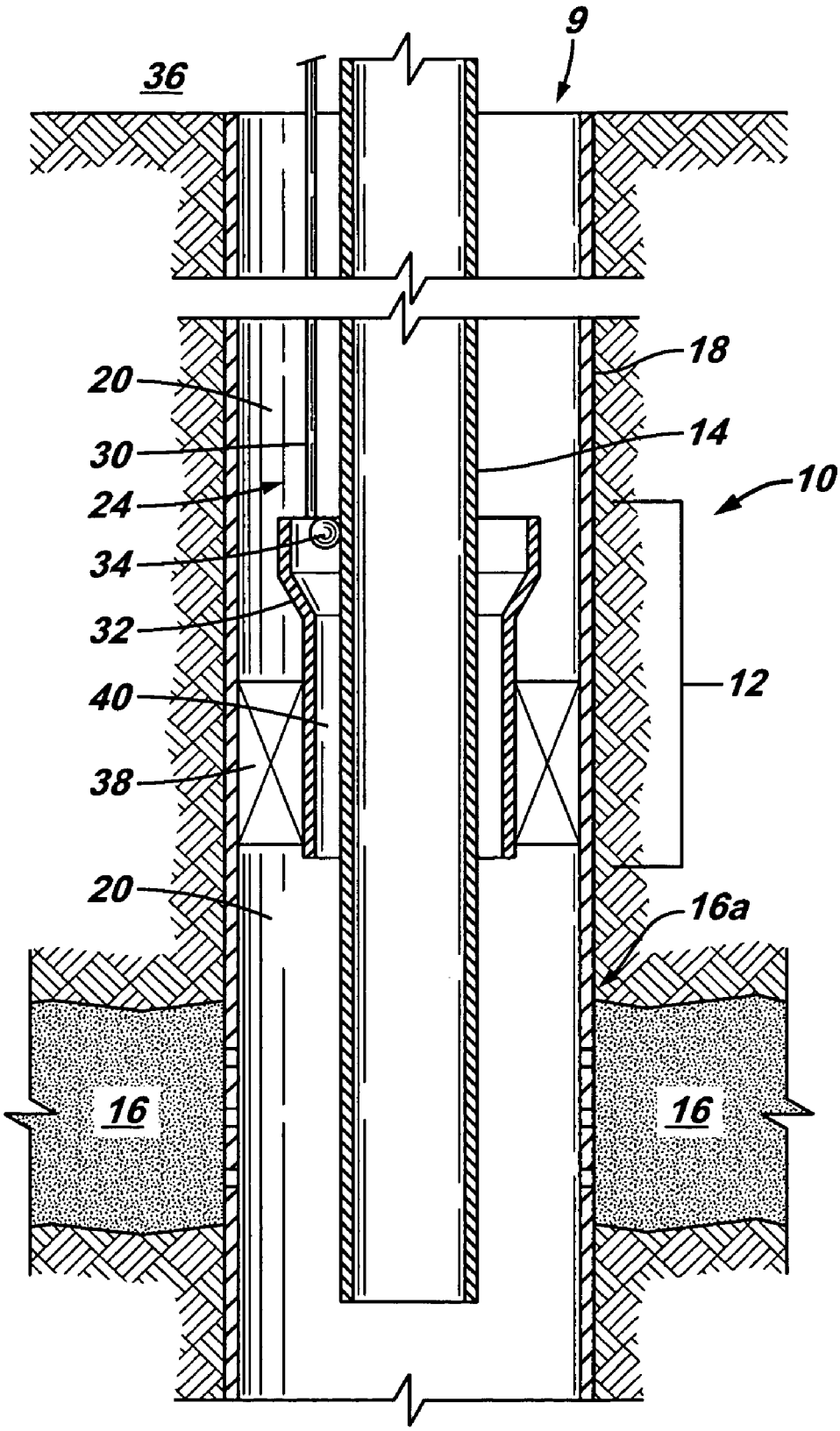
FIG. 3 is a schematic view of a subsurface annular safety barrier of the present invention.

FIG. 3 is a schematic view of another embodiment of subsurface annular safety barrier 10 of the present invention. In this embodiment annular barrier 12 includes tubing 14 carrying a packer 38 and an annular safety valve 32.

Annular barrier 12 is positioned proximate formation top 16*a* or at another position downhole where it may be expected that casing 18 integrity will be lost. Packer 38 is set in wellbore 18 to limit fluid flow in casing-tubing annulus 20 between formation 16 and upper portion 24 of annulus 20 through valve 32. Valve 32 includes a conduit 40 and a port 34 for allowing fluid flow therethrough.

Port 34 is operational from an open position allowing annular fluid communication from formation 16 through annular barrier 12 into upper portion 24 of casing-tubing annulus 20 to a close position restricting annular flow through annular barrier 12. Port 34 is maintained in an open position via pressure applied through control line 30. Upon loss of integrity of casing 18, pressure my be bled off of valve 32 closing valve port 34 isolating upper portion 24 of casing-tubing annulus 20 from formation 16.

As has been shown by example in FIGS. 1 through 3, subsurface annular safety barrier 10 provides for isolating formation 16 from an upper portion 24 of casing-tubing annulus 20 upon failure or loss of integrity of casing 18. The present invention provides a system and method for isolating formation 16 through casing-tubing annulus 20 downhole and proximate formation 16 without having to rig-up on the surface or to mechanically manipulate any of the pipe strings, such as tubing 14. Subsurface annular safety barrier 10 may be operated from the open to closed position manually and/or automatically upon realization that casing 18 integrity has been compromised.

Determination of when casing 18 integrity has been compromised may be conducted in numerous manners well known in the art. Examples of determining casing 18 failure include, but are not limited to, monitoring passive seismic wells, monitoring of casing and tubing flow characteristics in the production and/or injection lines and monitoring downhole conditions via utilization of downhole distributed fiber optic sensors, such as Schlumberger's Sensa DTS™ system, and other downhole monitoring systems. Automated monitoring and activation devices may be further utilized for monitoring of well characteristics and to operate subsurface annular safety barrier 10 from an open position allowing fluid communication through casing-tubing annulus 20 to a closed position isolating the formation 16 side of casing-tubing annulus 20 from the upper portion 24 of casing-tubing annulus 20. As indicated in reference to FIGS. 1 through 3, annular barrier 12 may be activated via manual and/or automatic controls.

With reference to FIGS. 1 through 3 a method of operating a subsurface annular safety barrier system 10 of the present invention is described. Wellbore 9 is drilled from the surface of the earth to a formation 16. Casing 18 is disposed within wellbore 9 and fluid communication is established between formation 16 into wellbore 9 to the surface. Tubing 14 is run into wellbore 9 and casing 18 to form a passageway through tubing 14 and a casing-tubing annulus 20. Carried with tubing 14 is an annular barrier 12 positioned proximate the top 16*a* of formation 16, or in another location desired in wellbore 9. Annular barrier 12 is initially disposed in an unset or open position allowing fluid communication through casing-tubing annulus 20 between formation 16 and the surface or upper portion 24 of annulus 20. This configuration of subsurface annular safety barrier permits production from and injection into formation 16 via casing-tubing annulus 20.

Upon realization that casing 18 integrity has been breached annular barrier 12 is motivated to the closed or set position to isolate formation 16 from upper portion 24 of casing-tubing annulus 20. This motivation of annular barrier 12 is performed utilizing pressure and not by mechanical manipulation, thus allowing for a quick response to the loss of integrity of casing 18.

From the foregoing detailed description of specific embodiments of the invention, it should be apparent that a subsurface annular safety barrier system for selectively closing a casing-tubing annulus upon loss of casing integrity that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A subsurface annular safety barrier system for use in a wellbore for producing fluid from and/or injecting fluid into a formation, the system comprising:

a casing;

a tubing disposed within the casing forming a casing-tubing annulus;

a check valve connected in the tubing permitting fluid flow from the casing-tubing annulus into the tubing and substantially preventing fluid flow from the tubing into the casing-tubing annulus;

a rod pump positioned in the tubing above the check valve; and an annular barrier carried by the tubing, the annular barrier being actuatable to substantially seal the casing-tubing annulus by pressurizing the tubing against the check valve.

2. The system of claim 1 wherein the annular barrier is a hydraulic packer.

3. A method of allowing production from and/or injection to a formation through the casing-tubing annulus-and providing for closure of the casing-tubing annulus comprising the steps of:

completing a wellbore to a formation with casing;

providing communication between the formation and the wellbore;

setting tubing within the casing to form a casing-tubing annulus;

connecting a check valve in the tubing permitting fluid flow from the casing-tubing annulus into the tubing and substantially preventing fluid flow from the tubing into the casing-tubing annulus;

positioning a rod pump in the tubing above the check valve;

setting an annular barrier carried by the tubing in an open position allowing fluid flow in the casing-tubing annulus across the annular barrier; and pressurizing the tubing against the check valve to actuate the annular barrier from the open to the closed position substantially blocking flow through the casing-tubing annulus across glue annular.

4. The method of claim 3 wherein the annular barrier is a hydraulically activated packer.

5. The method of claim 3, wherein the annular-barrier is actuated to the closed position after the casing fails.

* * * * *